United States Patent [19]

Yokoyama et al.

[11] Patent Number: 5,044,928

[45] Date of Patent: Sep. 3, 1991

[54] PULSE COMBUSTION DEVICE

[75] Inventors: Nobuyoshi Yokoyama; Susumu Ejiri, both of Toyoake, Japan

[73] Assignee: Paloma Kogyo Kabushiki Kaisha, Nagoya, Japan

[21] Appl. No.: 429,643

[22] Filed: Oct. 31, 1989

[30] Foreign Application Priority Data

Nov. 1, 1988 [JP] Japan ..... 63-276497

[51] Int. Cl.[5] ..... F22B 31/00; F23C 11/04

[52] U.S. Cl. ..... 431/1; 122/24

[58] Field of Search ..... 431/1; 122/24; 60/39.77

[56] References Cited

U.S. PATENT DOCUMENTS

| | | | |
|---|---|---|---|
| 1,948,541 | 2/1934 | Noack | 122/24 X |
| 2,708,926 | 5/1955 | Huber et al. | 60/39.77 X |
| 2,900,790 | 8/1959 | Reimers | 60/39.77 |
| 2,965,079 | 12/1960 | Collinson | 122/24 |
| 3,267,985 | 8/1966 | Kitchen | 122/24 X |
| 4,884,963 | 12/1989 | Kardos | 431/1 |
| 4,947,824 | 8/1990 | Ejiri et al. | 431/1 X |

FOREIGN PATENT DOCUMENTS

| | | | |
|---|---|---|---|
| 300706s | 8/1954 | Switzerland | 60/39.77 |
| 726995 | 3/1955 | United Kingdom | 60/39.77 |

*Primary Examiner*—Carl D. Price

*Attorney, Agent, or Firm*—Berman, Aisenberg & Platt

[57] ABSTRACT

In a pulse combustion device including a combustion chamber having a cylindrical wall, a forward end wall secured to one end of the cylindrical wall for attachment with a liquid vessel and being formed with an inlet port to be supplied with a mixture of gaseous fuel and air, and a rearward end wall secured to the other end of the cylindrical wall to close the combustion chamber, the cylindrical wall of the combustion chamber is formed with a plurality of circumferentially equally spaced radial exhaust ports which are located respectively in a position displaced from the center of the combustion chamber in an axial direction toward the inlet port, and a plurality of tailpipes are radially inwardly bent at their one ends and secured to the exhaust ports of the combustion chamber.

2 Claims, 2 Drawing Sheets

PULSE COMBUSTION DEVICE

BACKGROUND OF THE INVENTION

1. Field of the Invention

The present invention relates to a pulse combustion device adapted to a liquid vessel to heat an amount of liquid such as cooking oil or other fluid medium stored therein, and more particularly to an improvement of a combustion chamber and a tailpipe arrangement in the pulse combustion device.

2. Description of the Prior Art

As shown in FIG. 4, a conventional pulse combustion device of this kind includes a cylindrical combustion chamber 1 having a forward end wall formed with an inlet port 2 and a rearward end wall formed with an exhaust port for connection to a tailpipe 3. In FIG. 5 there is illustrated a combustion chamber 5 of another conventional pulse combustion device which is in the form of a volute casing having a forward end wall formed with an inlet port 6 in a tangential direction and a side wall formed with an exhaust port for connection to a tailpipe 7. In such pulse combustion devices, the combustion chamber 1 or 5 is immersed in liquid in a vessel associated thereto, and a spark plug 4 is mounted on the forward end wall of the combustion chamber at a position adjacent the inlet port.

The cylindrical combustion chamber 1 of FIG. 4 can be manufactured at a low cost by welding the component parts thereof. On start up, however, the mixture of gaseous fuel and air from inlet port 2 may not be rapidly ignited by energization of the spark plug 4. When resonant combustion of the mixture is initiated, a periodic reverse flow of the combustion products from tailpipe 3 causes a turbulent flow of the incoming mixture in the combustion chamber 1 as shown by dotted arrows in FIG. 4, resulting in irregular combustion of the mixture. This causes unstable combustion of the mixture and results in an increase of harmful components such as CO, HC and the like in the combustion products exhausted from tailpipe 3. On the other hand, the volute combution chamber 5 of FIG. 5 causes therein a vortex flow of the incoming mixture from inlet port 6. Thus, on start up, the mixture is rapidly ignited by energization of the spark plug 4 without any delay of time, and the vortex flow of the incoming mixture may not be disturbed by a periodic reverse flow of the combustion products from tailpipe 7. The volute combustion chamber 5, however, must be made of heat-resistant cast-iron, resulting in an increase of manufacturing cost.

SUMMARY OF THE INVENTION

It is, therefore, a primary object of the present invention to provide an improved pulse combustion device the combustion chamber of which can be manufactured at a low cost and arranged to cause therein a stable vortex flow of the incoming mixture thereby to decrease an amount of unburned mixture in the combustion products.

According to the present invention, the object is accomplished by providing a pulse combustion device which comprises a combustion chamber having a cylindrical wall, a forward end wall secured to one end of the cylindrical wall for attachment with a liquid vessel and being formed with an inlet port to be supplied with a mixture of gaseous fuel and air, and a rearward end wall secured to the other end of the cylindrical wall to close the combustion chamber, wherein the cylindrical wall of the combustion chamber is formed with a plurality of circumferentially equally spaced radial exhaust ports which are located respectively in a position displaced from the center of the combustion chamber in an axial direction toward the inlet port, and wherein a plurality of tailpipes are radially inwardly bent at their one ends and secured to the exhaust ports of the combustion chamber.

In a practical embodiment of the present invention, a cylindrical decoupler is arranged coaxially with the combustion chamber at its rear side, and the tailpipes are extended rearwardly from the exhaust ports of the combustion chamber in parallel along the cylindrical decoupler and turned forwardly at their intermediate portions, the tailpipes being radially inwardly bent at their other ends and secured to a front end of the decoupler for communication with the interior of the decoupler. Preferably, an exhaust pipe is radially inwardly bent at its one end and secured to a rear portion of the cylindrical decoupler for communication with the interior of the decoupler, the exhaust pipe being extended forwardly along the decoupler and arranged between the tailpipes adjacent thereto.

BRIEF DESCRIPTION OF THE DRAWINGS

Additional objects, features and advantages of the present invention will become more readily apparent from the following detailed description of a preferred embodiment thereof when considered with reference to the accompanying drawings, in which.

DESCRIPTION OF THE PREFERRED EMBODIMENT

Figure 1:
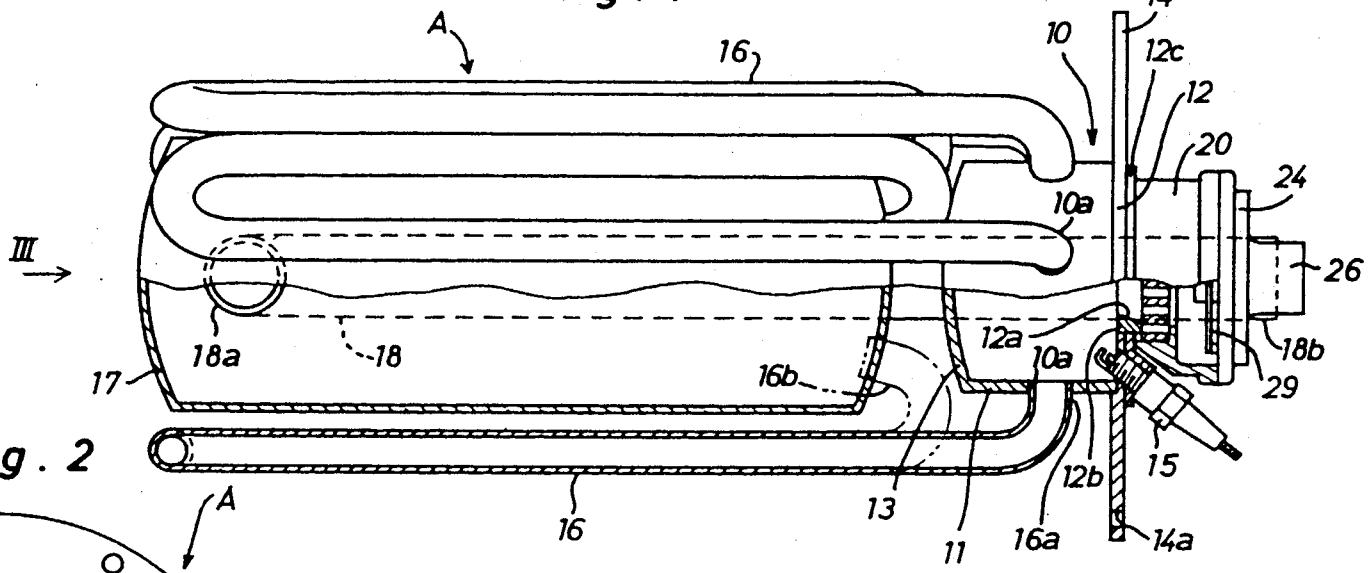
FIG. 1 is a partly sectioned side view of a pulse combustion device in accordance with the present invention.
Figure 2:
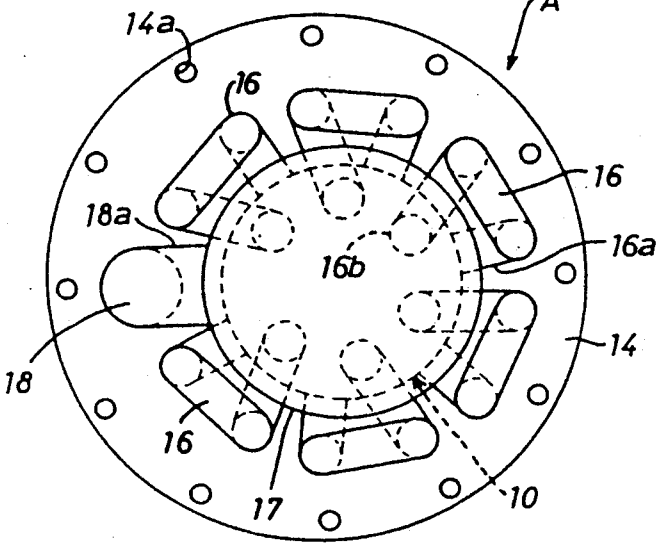
FIG. 2 is a rear view of the pulse combustion device illustrated in a direction shown by an arrow III in FIG. 1.
Figure 3:
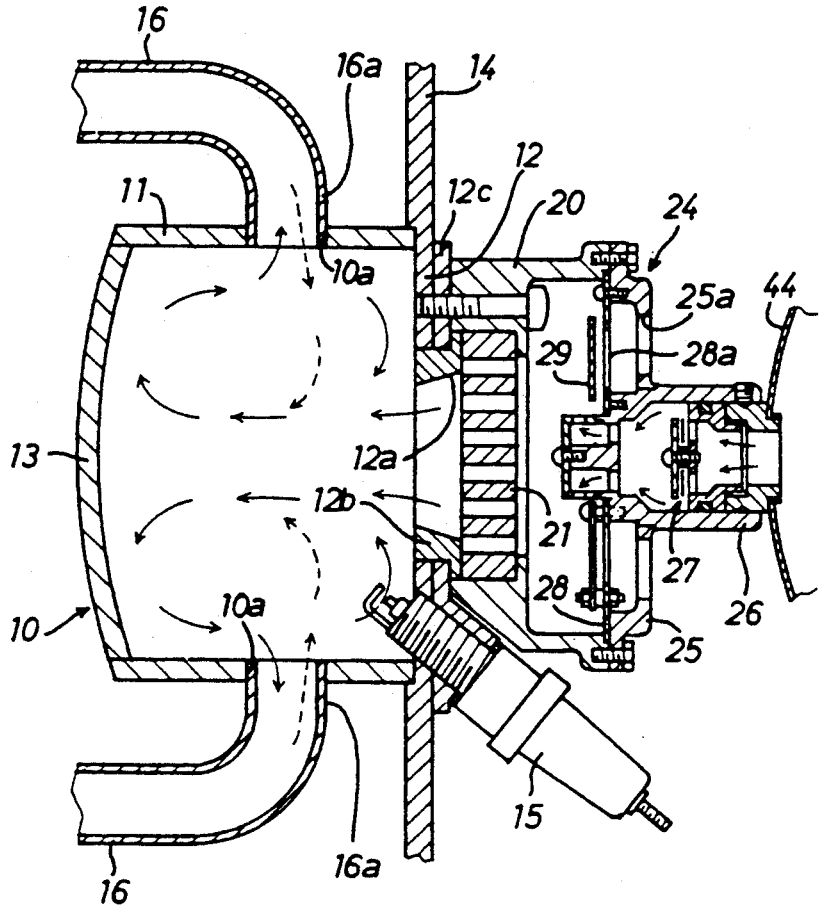
FIG. 3 is an enlarged sectional view of a combustion chamber of the pulse combustion device shown in FIG. 1.

Disclosed in FIGS. 1 and 2 of the drawings is a pulse combustion device A in accordance with the present invention, which comprises, as main component parts thereof, a combustion chamber 10 unitedly constructed by welding the component parts thereof, a plurality of tailpipes 16, a cylindrical decoupler 17, an exhaust pipe 18, an air-fuel mixer head 20 mounted to an inlet of the combustion chamber 10, and a valve assembly 24 mounted to the air-fuel mixer head 20. As shown in FIGS. 1 and 3, the combustion chamber 10 has a cylindrical wall 11 and forward and rearward end walls 12 and 13 welded to the opposite ends of cylindrical wall 11. The forward end wall 12 is reinforced by a reinforcement plate **12*c* welded thereto and is integrally formed with a circular attachment plate 14. A burner head 12*b* is securedly coupled with central apertures of the forward end wall 12 and reinforcement plate 12*c* and has a tapered inlet port 12*a* formed therein. A spark plug 15 is threaded into the forward end wall 12 through the reinforcement plate 12*c*** at an inclined angle and has an electrode located in the combustion chamber 10. As shown in FIG. 1, the attachment plate 14 is formed at its periphery with a plurality of circumferentially spaced mounting holes 14*a* for attachment with a liquid vessel (not shown). In a practical embodiment of the present invention, the burner head 12 may be positioned at another place of the forward end wall 12.

The combustion chamber 10 is formed at its cylindrical wall 11 with a plurality of circumferentially equally spaced radial exhaust ports 10*a* which are located respectively in a position displaced in a slight distance from the center of combustion chamber 10 in an axial direction toward the inlet port 12*a*. The plurality of tailpipes 16 are radially inwardly bent at their one ends and welded to the exhaust ports 10*a* of combustion chamber 10. The tailpipes 16 are extended rearwardly from the exhaust ports 10*a* in parallel along the cylindrical decoupler 17 and turned forwardly at their intermediate portions. The cylindrical decoupler 17 is closed at its opposite ends and arranged coaxially with the combustion chamber 10 at its rear side. The tailpipes 16 are radially inwardly bent at their other ends and welded to the front end of decoupler 17 for communication with the interior of decoupler 17. The exhaust pipe 18 is radially inwardly bent at its one end 18*a* and welded to a rear portion of decoupler 17 for communication with the interior of decoupler 17. The exhaust pipe 18 is extended forwardly along the decoupler 17 and arranged between the two tailpipes 16 adjacent thereto as shown in FIG. 2. The other end 18*b* of exhaust pipe 18 is extended outwardly through the attachment plate 14 and welded at its intermediate portion to the attachment plate 14 in a liquid-tight manner. The decoupler 17 has an expansion chamber of large capacity formed therein for stabilizing pulse combustion of the mixture in the combustion chamber 10 and for absorbing combustion noises applied thereto. The decoupler 17 is horizontally supported on the attachment plate 14 by means of the tailpipes 16 and exhaust pipe 18.

As shown in FIGS. 1 and 3, the air-fuel mixer head 20 is secured to the forward end wall 12 of combustion chamber 10 through the reinforcement plate 12*c* by means of fastening bolts, and a perforated flame trap 21 is retained in place between the burner head 12*b* and the mixer head 20. Thus, the air-fuel mixer head 20 is communicated with the interior of combustion chamber 10 through the flame trap 21 and burner head 12*b*. The valve assembly 24 includes an annular flange member 25 secured to the open end of mixer head 20 in a fluid-tight manner by means of bolts, and a cylindrical member 26 welded in the center of flange member 25 to form therein a gas passage in open communication with the interior of mixer head 20. The flange member 25 is formed with a plurality of circumferentially equally spaced openings 25*a* in surrounding relationship with the gas passage in cylindrical member 26. The cylindrical member 26 is provided therein with a flapper-type gas inlet valve unit 27 and is connected to a gas container 44. The gas inlet valve unit 27 is arranged to permit inward flow of gaseous fuel passing therethrough from the gas container 44 into the mixer head 20 and to block outward flow of fuel-air mixture from the mixer head 20.

An annular seat plate 28 is secured to an internal annular surface of flange member 25 by means of screws, and an annular deflector plate 29 is secured to the annular seat plate 28 through spacers by means of bolts and nuts. The annular seat plate 28 is formed with a plurality of circumferentially equally spaced radial slots 28*a* for permitting inward flow of fresh air passing therethrough into the mixer head 20, and the deflector plate 29 is arranged to block outward flow of fuel-air mixture from the mixer head 20. The gas container 44 is connected to a source of gaseous fuel under pressure by means of a gas supply conduit (not shown). The mixer head 20, valve assembly 24 and gas container 44 are housed in an air chamber (not shown) which is mounted to the attachment plate 14 to be supplied with fresh air under pressure from an air blower (not shown) through an air supply pipe.

For operation of the pulse combustion device, gaseous fuel is supplied into the mixer head 20 from the container 44 through the gas inlet valve unit 27, while fresh air is supplied into the mixer head 20 from the air chamber through the radial slots 28*a* of seat plate 28. The gaseous fuel is mixed with the incoming fresh air in the mixer head 20 and supplied into the combustion chamber 10 through the flame trap 21 and inlet port 12*a*. The mixture of gaseous fuel and air from inlet port 12*a* flows rearwardly along the center line of combustion chamber 10 as shown by solid arrows in FIG. 3 and turns radially outwardly by abutment with the internal surface of rearward end wall 13 to be returned forwardly along the internal surface of cylindrical wall 11. Thus, the mixture turns radially inwardly by abutment with the internal surface of forward end wall 12 and is mixed with the incoming mixture to cause a doughnut-like vortex flow of the mixture in the whole interior of combustion chamber 10. In addition, a portion of the mixture flows into the respective tailpipes 16.

On start up, the spark plug 15 is energized for a predetermined period of time, and the vortex flow of mixture causes the incoming mixture to flow toward the electrode of spark plug 15. Thus, the mixture is rapidly ignited by energization of the spark plug 15 without any delay of time. The pressure of the resulting rapid combustion of the mixture closes the gas inlet valve unit 27 and forces the combustion products to exhaust from the tailpipes 16. When resonant combustion is initiated, oscillation takes place in the tailpipes, creating alternate positive and negative pressures in the tailpipes 16. During periods of negative pressure in the combustion chamber 10, the gas inlet valve unit 27 is opened to introduce gaseous fuel into the mixer head 20 from the gas container 44, and fresh air is introduced into the mixer head 20 through the slots 28*a* of seat plate 28. The mixture of fresh gaseous fuel and air is reignited by a flame caused by the resonant combustion. In this instance, the combustion products of high temperature flows reversely from the tailpipes 16 into the combustion chamber 10. The reverse flow of combustion products is caused radially inwardly across the flow of incoming mixture along the internal surface of cylindrical wall 11 as shown by dotted arrows in FIG. 3. Thus, the reverse flow of combustion products slightly disturbs the vortex flow of mixture at a portion adjacent the inlet port 12*a* but forces the vortex flow of mixture at a portion adjacent the exhaust ports 10*a* displaced toward the inlet port 12*a*. This is effective to ensure stable combustion of the mixture in the combustion chamber 10 so as to decrease an amount of harmful components in the combustion products. During intermittent periods of positive pressure in the combustion chamber 10, the gas inlet valve unit 27 is closed and the deflector plate 29 acts to block outward flow of the combustion products. The reignition of each fresh air-fuel mixture is continuously repeated at a frequency, for instance, about 100 cycles per second.

Figure 4:
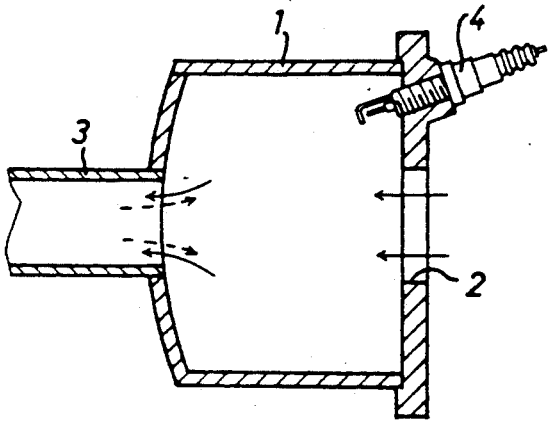
FIG. 4 is a sectional view of a combustion chamber of a conventional pulse combustion device.
Figure 5:
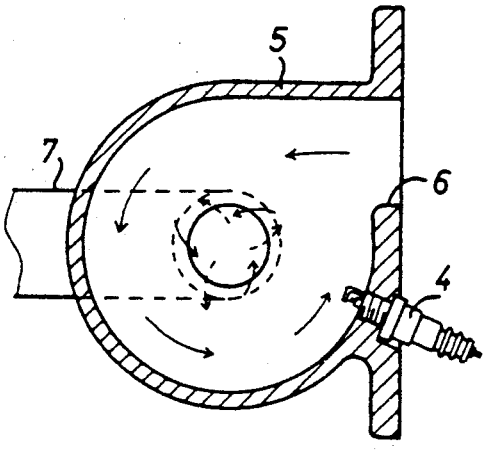
FIG. 5 is a sectional view of a combustion chamber of another conventional pulse combustion device.

In a practical embodiment of the present invention, the combustion chamber 10 of the pulse combustion device can be manufactured at a low cost by welding the component parts thereof substantially in the same manner as the conventional combustion chamber 1 shown in FIG. 4.

Although the preferred embodiment of the present invention has been shown and described above, it should be understood that various modifications and rearrangements of the parts may be resorted to without departing from the scope of the invention as disclosed and claimed herein. For example, the deflector plate 29 in the valve assembly 24 may be replaced with a conventional flapper valve unit, and the number of tailpipes 16 may be reduced or increased as necessary.

What is claimed is:

1. A pulse combustion device comprising a combustion chamber having a cylindrical side wall, a forward end wall secured to a first end of the cylindrical wall for attachment with a liquid vessel, said forward end wall comprising an inlet port to be supplied with a mixture of gaseous fuel and air, a rearward end wall secured to a second end of the cylindrical wall to close said combustion chamber and a spark plug mounted on the forward end wall, said spark plug having an electrode located in said combustion chamber, wherein the cylindrical wall of said combustion chamber is formed with a plurality of circumferentially equally spaced radial exhaust ports, which are located respectively in a position adjacent the inlet port of said forward end wall and wherein a plurality of tailpipes are secured at first ends thereof to the exhaust ports of said combustion chamber and extended substantially radially outwardly therefrom, wherein a cylindrical decoupler is arranged coaxially with said combustion chamber, and wherein said tailpipes are extended rearwardly from the exhaust ports of said combustion chamber in parallel axially along said cylindrical decoupler and turned forwardly at their intermediate portions, said tailpipes being radially inwardly bent at second ends thereof and secured to a forward end of said decoupler for communication with the interior of said decoupler.

2. A pulse combustion device as claimed in claim 1, wherein a first end of an exhaust pipe is radially inwardly bent and secured to a rear portion of said cylindrical decoupler for communication with the interior of said decoupler, said exhaust pipe being extended forwardly along said decoupler and arranged between the tailpipes adjacent thereto.

* * * * *